United States Patent [19]

Bonnycastle et al.

[11] 4,409,155

[45] Oct. 11, 1983

[54] EXPLOSIVE BOOSTER MANUFACTURE

[75] Inventors: Joseph R. Bonnycastle, St. Bruno; Alfred G. Michaud; Edward K. Rowley, both of Beloeil, all of Canada

[73] Assignee: C-I-L Inc., North York, Canada

[21] Appl. No.: 217,856

[22] Filed: Dec. 18, 1980

[30] Foreign Application Priority Data

Feb. 4, 1980 [CA] Canada ..... 345004

[51] Int. Cl.[3] ..... C06B 21/00

[52] U.S. Cl. ..... 264/3 R; 86/20 R; 86/20 D; 102/289

[58] Field of Search ..... 102/285, 289, 283; 264/3 R; 86/20 R, 20 C, 20 D

[56] References Cited

U.S. PATENT DOCUMENTS

| | | | |
|---|---|---|---|
| 2,995,011 | 8/1961 | Kimmel | 102/285 X |
| 3,345,438 | 10/1967 | Carey | 264/3 R |
| 3,379,796 | 4/1968 | Hewson et al. | 264/3 R |
| 3,926,697 | 12/1975 | Humbert et al. | 264/3 R X |
| 3,961,554 | 6/1976 | Harris et al. | 86/20 R X |
| 4,014,963 | 3/1977 | Gawlick et al. | 264/3 R X |
| 4,050,347 | 9/1977 | Adelman et al. | 86/20 R |
| 4,085,173 | 4/1978 | Lomax, Jr. et al. | 264/3 R |

*Primary Examiner*—Peter A. Nelson

*Attorney, Agent, or Firm*—Donald G. Ballantyne

[57] ABSTRACT

A semi-automatic, semi-continuous method is provided for the manufacture of cast explosive boosters. The method makes us of a mold assembly which is transported through filling, cooling and disassembly stations in a substantially continuous manner with little or no manual intervention. The method is adaptable to the manufacture of sheath/core or multiple layer boosters employing two explosives of different sensitivities. The method results in reduced operating costs and improved safety.

5 Claims, 5 Drawing Figures

EXPLOSIVE BOOSTER MANUFACTURE

This invention relates to a semi-automatic, semi-continuous method of producing shaped castings of thermosettable explosive materials. In particular, the invention deals with the semi-automatic production of shaped cast explosive boosters of the type employed for the initiation of insensitive explosive charges.

In the art of blasting it has long been the practice to initiate a less sensitive explosive by means of more sensitive explosive. With the advent of the particularly insensitive economic blasting agents such as ammonium nitrate/fuel oil (ANFO) mixtures or the nitrocarbo nitrate slurries, it became necessary to develop an economic, safe and easily employed primer or booster charge for the initiation of these explosives. A variety of such boosters are disclosed in the prior art. U.S. Pat. No. 3,037,452 describes a cast booster comprising a cast core of detonating-cord-sensitive material surrounded by a sheath of cast material which is insensitive to detonating cord. U.S. Pat. No. 3,037,453 discloses a similar core/sheath cast booster wherein the core comprises a FIG. 8 configuration detonating cord. U.S. Pat. No. 3,491,688 discloses a molded booster comprising resin-bonded PETN, TNT, tetrytol or mixtures of these. U.S. Pat. No. 3,437,038 discloses a cast pentolite or similar booster having a length of detonating cord cast in-place therein. U.S. Pat. No. 3,604,353 discloses a two component cast booster assembly wherein one component consists of a more sensitive layer of pentolite and a less sensitive layer of TNT. U.S. Pat. No. 4,009,060 discloses a cast booster consisting of a TNT/DNT mixture containing fine grained PETN distributed therein.

The manufacture of all the aforementioned boosters has generally been limited to manual methods. Typically, the explosive is heated to achieve a molten state and poured or withdrawn from a dispensing apparatus into a paper or plastic form where it is allowed to cool. After cooling and solidification, the cast boosters with their integral forms are packaged for storage or shipment. Where core/sheath boosters are manufactured, additional manual steps are required in preparing the core casting or more assembly which after solidification is then covered with the sheath materials in a suitable mold. Where passages or recesses are required in the casting for the insertion or attachment of detonating cords or blasting caps, pins or other means used to produce the passages, are removed by hand. Such manual methods of manufacture are particularly labour intensive and hence costly. In addition, workers may be exposed to fumes which can be detrimental to health and the danger of burns is ever present. The maintenance of a safe working environment is difficult.

The manufacturing process of the present invention overcomes substantially all of the aforementioned disadvantages by providing a semi-continuous preparation, melting, dispensing and cooling method whereby there is achieved a substantial improvement in productivity and safety.

The semi-automatic, semi-continuous method for the manufacture of cast explosive boosters of the invention comprises the steps of:

(a) preparing an assembly consisting of a base plate, a tubular shell removably secured to said base plate, one or more operative pins removably secured to said base plate within the confines of said tubular shell and, optionally, a core mold piece affixed to said removable pins, said core mold piece adopted to occupy space within the confines of said tubular shell;

(b) advancing said assembly to an inspection and indexing station where leakproof mounting of the said tubular shell on the said base plate is provided;

(c) advancing the said assembly to a molten explosives dispensing station;

(d) filling the said tubular shell with molten explosives;

(e) advancing the said assembly and filled tubular shell to a cooling station;

(f) advancing the said cooled tubular shell and assembly to a disassembly station where the said pins, the said optional core mold piece and the said base plate are separated from the said filled tubular shell; and (g) advancing the said filled, cooled shell to a packaging station.

In an operation where a two component cast booster is manufactured, that is, a booster having, for example, a sheath/core or a multi-layer construction, an additional filling step and cooling step after step (e) are required. In the manufacture of a sheath/core type booster, this may be accomplished by separating only the core mold piece in step (f) thus creating a void space around the pins and thereafter filling the void space with a second, more sensitive explosive. In the manufacture of a multi-layer booster, the optional core mold piece is discarded and two successive pours of explosives each filling a portion of the shell and each followed by a cooling step, can be employed.

The present invention and the sequential unit operations comprising the method may be more fully understood by reference to the accompanying drawings wherein.

Figure 1:
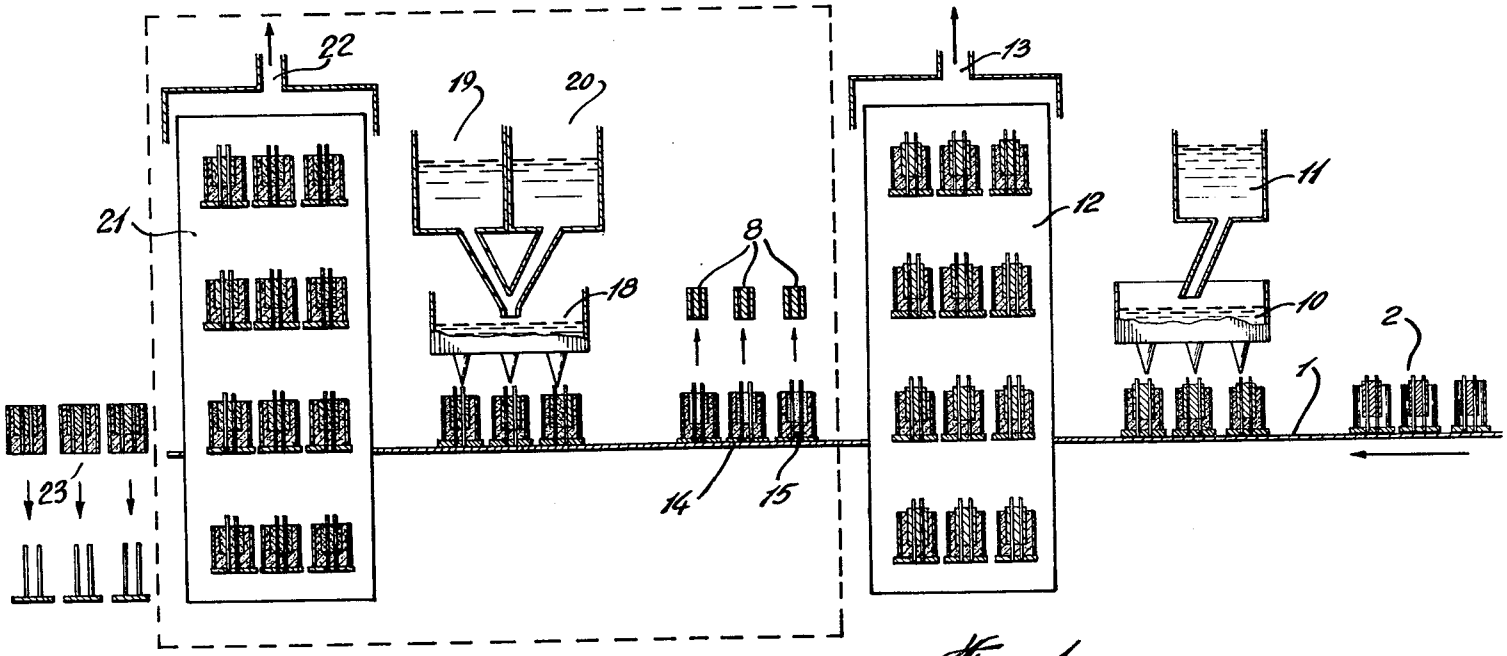
FIG. 1 is a schematic or diagrammatic flow sheet showing the method and essential apparatus of the present invention.
Figure 2:
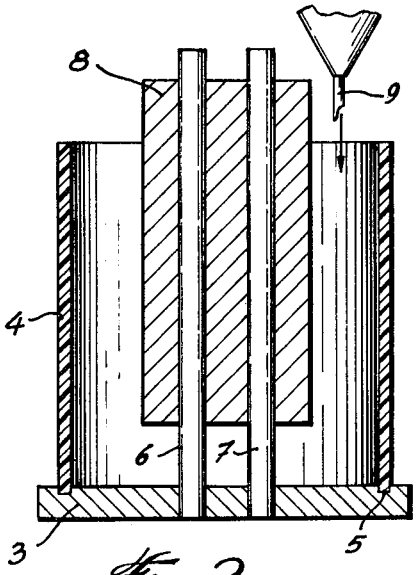
FIG. 2 shows a cross-sectional view of the casting of the exterior explosive sheath of a sheath/core booster.
Figure 3:
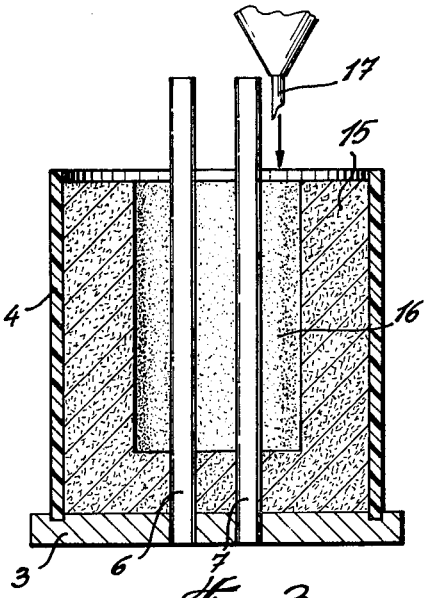
FIG. 3 shows a cross-sectional view of the casting of the interior explosive core of a sheath/core booster.

With reference to the figures of the drawings, FIG. 1 shows each of the essential unit operations in combination with the others in the semi-automatic process for the manufacture of sheath/core boosters while FIGS. 2 and 3 show in enlarged detail the actual casting steps in the manufacture of a sheath/core booster. The apparatus depicted includes a chain or belt 1 adapted to move in the direction indicated by the arrow. An assembly of molds 2 is shown in position at the beginning end of the process upon belt 1. Mold 2, with reference to FIG. 2, comprises a base 3 preferably of metal upon which is supported a cylindrical cardboard, metal or plastic tube 4. Preferably, tube 4 is set into a circular groove 5 in base 3. Base 3 also contains one or more apertures or recesses in which are set pins or rods 6 and 7. Base 3 is desirably made of a metal having good heat conduction to aid in cooling. Pins 6 and 7 correspond in diameter to a conventional blasting cap or detonating cord. Supported in tight-fitting but removable fashion upon pins 6 and 7 within tube 4 is metal core mold piece 8. Mold piece 8 may be raised or lowered to a greater or lesser weight above base 3 in order to occupy a desired volume of space within tube 4. A detonating cord-insensitive explosive 9, for example TNT, is shown being poured into the space within tube 4.

Figure 4:
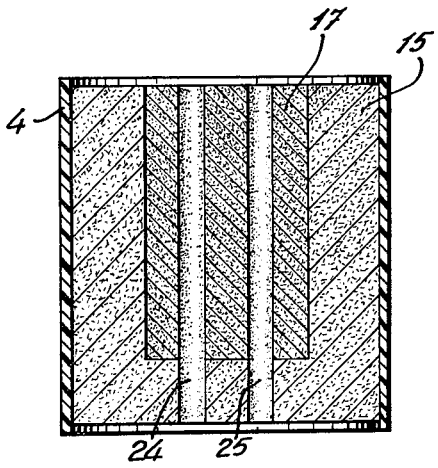
FIGS. 4 and 5 show cross-sectional view of alternative forms of sheath/core booster products.
Figure 5:
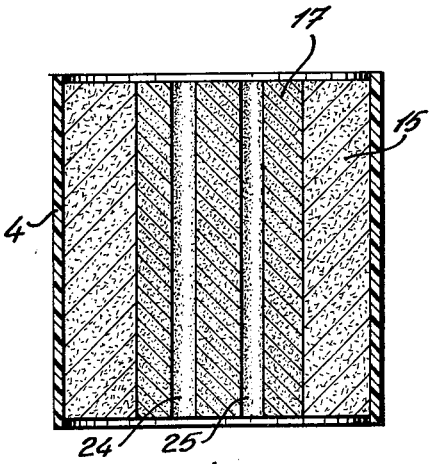

The assembly of molds 2 as shown in FIG. 1 (shown as three in number but is not intended to be so limited) is prepared near the beginning of belt 1 where tube 4 is pressed into base 3 and the completed mold assembly visually inspected, is advanced on belt 1 to a position beneath molten TNT dispenser 10. Dispenser 10 is fed from TNT melt tank 11. The empty molds are charged with molten TNT from dispenser 10. For efficiency and speed-up of the subsequent cooling cycle, the charging of molds 2 with TNT preferably comprises three steps (not shown) which steps consist of (1) a small pour of molten TNT which quickly cools to seal the base of the mold, (2) a charging of the mold with solid, pelleted TNT particles and (3) a final pour of molten TNT to fill the voids between the TNT pellets. After charging with TNT, the charged molds 2 are advanced to cooling station 12. Cooling station 12 is preferably a vertically revolving stack in the manner of a ferris wheel where the hot molds 2 are collected in groups on carrying trays. The cooling stack is caused to revolve in stages which corresponds with the speed of charging of the molds 2 with TNT and the time required to solidify the TNT. Heat from cooling stack 12 is exhuasted at vent 13. After a complete revolution upon cooling stack 12, the assembly of molds 2 is off-loaded to a core piece extraction station 14 where by means of appropriate mechanisms (not shown), the metal core piece 8 is removed from the now cooled cast TNT leaving a solidified cup or cylinder of TNT sheath material 15 having a recess 16 therein containing metal pins or rods 6 and 7 upon base 3. After extraction of core piece 8, the assembly of molds 2 is advanced to a core material charging station where a more sensitive explosive, for example, molten pentolite 17 is poured into the recess 16 from pentolite dispenser 18. Dispenser 18 is fed from TNT melt tank 19 and PETN melt tank 20. After charging with pentolite, the assembly of molds 2 is advanced to a second revolving cooling station or stack 21 where the charged molds are allowed to cool. Heat from stack 21 is exhausted through vent 22. After a complete timed revolution in stack 21 the assembly of cooled and solidified molds is off-loaded to a pin extraction station 23 where, by means of appropriate mechanisms (not shown) pins 6 and 7 and base piece 3 are separated from the now cooled casting, leaving a sheath/core booster similar to those shown in FIGS. 4 and 5 where channels 24 and 25, produced by the removal of pins 6 and 7, are adapted to receive a blasting cap or length of detonating cord. Extracted base piece 3, pins 6 and 7 and core piece 8 are returned to the assembly station at the start end of belt 1 for assembly for subsequent casting operations. The finished boosters are accumulated for packaging and shipment.

The above-described process and apparatus refers only to the essential sequential steps involved in the method of the invention and leaves open to those skilled in the art the various means available by which the steps of the process may be undertaken. For example, the assembly of the empty molds 2 may be accomplished by manual means, automatic mechanical means or a combination of both. The fitting of tube 4 into recess 5 in base 3, for example, may be effected by means of a mechanical, hydraulic or pneumatic tube press. The feeding of solid TNT to melter 11 is preferably by mechanical conveyor or bucket elevator. The positioning, indexing, loading and off-loading of the molds 2 at various locations along the production line may be by, for example, hydraulic or pneumatic pistons or stop gates as may be the opening and closing of valves on the molten explosives dispensing apparatus. Indeed, the entire operation may be controlled by means of computer, where fail-safe steps can be incorporated in the program. Various washing or refurbishing steps may also be added to the process to prepare the various reuseable components (base, pins, etc.) for subsequent castings.

It will be appreciated that where a homogeneous booster is made, that is, a booster comprising a single pour of, for example, TNT or pentolite, that only part of the method and apparatus depicted in FIG. 1 need be employed. That apparatus enclosed within the dashed line of FIG. 1 may be bypassed in the manufacture of a single pour casting. In this event, the core piece 8 would be omitted from the mold assembly.

In the manufacture of a sheath/core booster as herein described, the sheath explosive material 9, for example TNT, is poured at a temperature slightly above that at which it melts, about 80° C. for TNT. It is desirable to incorporate into the molten TNT small pellets or prills of solid TNT since it has been found that the presence of such pellets speeds cooling and eliminates the formation of a contraction cavity which frequently forms when TNT is cast. The temperature of the core explosive 17 when poured is desirably several degrees higher than the melting temperature of the sheath explosive 9. This temperature differential permits some melting of the sheath explosive where it contacts the core explosive and thus creates an intermingling of the core and sheath material at the interface. Such intermingling insures fusion of the two materials, eliminates any crack or gap into which water could penetrate and provides for an efficient detonation transfer from core to sheath during initiation.

In any booster of the type described, the ratio of core material to sheath material will depend on the kinds of explosives chosen. Generally about four parts by weight of sheath material are used for each part of core material. In some cases economies in the use of core material can be realized by shaping the core material as a shaped charge in order to utilize the well known directional effect of such shaped charges. The method of the invention permits easy adaptation of various core shapes simply by providing a core mold piece 8 having the desired shaped-charge configuration.

The production of cast explosive boosters in the present invention is ideally carried out with a minimum of manual operations and proceeds continuously through a remote control system to provide a substantial improvement in productivity and safety and a reduction in cost. In addition, the total amount of explosives present in the operating facility can be carefully monitored for further safety.

We claim:

1. A semi-automatic, semi-continuous method for manufacturing a cast high explosive booster which comprises the consecutive steps of:

(a) preparing an assembly consisting of a base plate, a tubular shell removably secured to said base plate and one or more operative pins removably secured to said base plate within the confines of said tubular shell;

(b) advancing said assembly to an inspection and indexing station where leakproof mounting of the said tubular shell on the said base plate is provided;

(c) advancing the said assembly to a molten explosives dispensing station;

(d) filling the said tubular shell with molten explosives;

(e) advancing the said assembly and filled tubular shell to a cooling station;

(f) advancing the said cooled tubular shell and assembly to a disassembly station where the said pins and the said base plate are separated from the said filled tubular shell; and (g) advancing the said filled, cooled shell to a packaging station.

2. A method as claimed in claim 1 wherein the molten explosive filling step (d) comprises a first and second pour of explosive, the said second pour of explosive comprising an explosive more sensitive to initiation than the said first pour of explosive.

3. A semi-automatic, semi-continuous method for manufacturing a cast high explosive booster which comprises the consecutive steps of:

(a) preparing an assembly consisting of a base plate, a tubular shell removably secured to said base plate, one or more operative pins removably secured to said base plate within the confines of said tubular shell and a core mold piece affixed to said removable pins, said core mold piece adapted to occupy space around the said pins and within the confines of said tubular shell;

(b) advancing said assembly to an inspection and indexing station where leakproof mounting of the said tubular shell on the said base plate is provided;

(c) advancing the said assembly to a first molten explosive dispensing station;

(d) filling the said tubular shell with a first molten explosives;

(e) advancing the said assembly and filled tubular shell to a first cooling station;

(f) separating the said core mold piece from the said pins and the said filled and cooled tubular shell to create a void space in the said filled shell around the said pins;

(g) advancing the said void-containing filled shell to a second molten explosives dispensing station;

(h) filling the said void space in the said shell with said second molten explosives;

(i) advancing the said assembly and filled shell to a second cooling station;

(j) advancing the said cooled tubular shell and assembly to a disassembly station where the said pins and the said base plate are separated from the said filled tubular shell; and (k) advancing the said filled, cooled shell to a packaging station.

4. A method as claimed in claim 3 wherein the said second molten explosives comprises a material more sensitive to initiation than the said first molten explosives.

5. A method as claimed in claim 2 or 4 wherein the melt temperature of the more sensitive second molten explosives is in excess of the melt temperature of the said first molten explosives.

* * * * *

UNITED STATES PATENT AND TRADEMARK OFFICE

CERTIFICATE OF CORRECTION

PATENT NO. : 4,409,155

DATED : October 11, 1983

INVENTOR(S) : Joseph R. Bonnycastle et al.

It is certified that error appears in the above-identified patent and that said Letters Patent is hereby corrected as shown below:

On the title page, item /73/ add:

-- David J. Shearing, Montreal, and

John D. Simpson, St. Hilaire, Canada --.

Signed and Sealed this

*Fourteenth* Day of *February 1984*

[SEAL]

*Attest:*

GERALD J. MOSSINGHOFF

*Attesting Officer*

*Commissioner of Patents and Trademarks*